US011434897B2

(12) United States Patent
Yanagibayashi et al.

(10) Patent No.: US 11,434,897 B2
(45) Date of Patent: Sep. 6, 2022

(54) LIQUID DELIVERY DEVICE

(71) Applicant: SHIMADZU CORPORATION, Kyoto (JP)

(72) Inventors: Jun Yanagibayashi, Kyoto (JP); Keisuke Ogawa, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 375 days.

(21) Appl. No.: 16/629,421

(22) PCT Filed: Jul. 28, 2017

(86) PCT No.: PCT/JP2017/027525
§ 371 (c)(1),
(2) Date: Jan. 8, 2020

(87) PCT Pub. No.: WO2019/021475
PCT Pub. Date: Jan. 31, 2019

(65) Prior Publication Data
US 2020/0182235 A1 Jun. 11, 2020

(51) Int. Cl.
*F04B 49/06* (2006.01)
*F04B 11/00* (2006.01)
(Continued)

(52) U.S. Cl.
CPC ..... *F04B 49/06* (2013.01); *F04B 1/02* (2013.01); *F04B 11/0058* (2013.01);
(Continued)

(58) Field of Classification Search
CPC .... F04B 1/02; F04B 11/0058; F04B 11/0075; F04B 23/06; F04B 49/06;
(Continued)

(56) References Cited

U.S. PATENT DOCUMENTS 8,297,936 B2 10/2012 Witt
8,535,016 B2 9/2013 Corral
(Continued)

FOREIGN PATENT DOCUMENTS

JP S61-178569 A 8/1986
WO 2017/094097 A1 6/2017

OTHER PUBLICATIONS

International Search Report for corresponding Application No. PCT/JP2017/027525, dated Oct. 24, 2017.
(Continued)

*Primary Examiner* — Devon C Kramer
*Assistant Examiner* — Joseph S. Herrmann
(74) *Attorney, Agent, or Firm* — Renner, Otto, Boisselle & Sklar, LLP

(57) ABSTRACT

A liquid feeding device includes a discharge channel, a pump part, a feeding pressure sensor, a non-discharge pressure sensor, a pre-compression part, and a pre-compression speed determination part. The pump part has plunger pumps connected in series or parallel. At least one of the plunger pumps is a closed pump in which communication with the discharge channel is disconnected during a non-discharge time. The pre-compression part causes the closed pump that is after the suction process for sucking the liquid into a pump
(Continued)

chamber is completed and during the non-discharge time to execute a pre-compression process to perform a discharge operation until a non-discharge pressure is substantially the same as a feeding pressure based on output of the feeding pressure sensor and output of the non-discharge pressure sensor. The pre-compression speed determination part determines a pre-compression speed of the closed pump in the pre-compression process.

13 Claims, 10 Drawing Sheets

(51) Int. Cl.
*F04B 13/00* (2006.01)
*F04B 23/06* (2006.01)
*F04B 1/02* (2006.01)

(52) U.S. Cl.
CPC ..... *F04B 11/0075* (2013.01); *F04B 13/00* (2013.01); *F04B 23/06* (2013.01); *F04B 2201/0202* (2013.01); *F04B 2205/03* (2013.01); *F04B 2205/05* (2013.01)

(58) Field of Classification Search
CPC ..... F04B 2201/0202; F04B 2205/03; F04B 2205/05; G01N 2030/324; G01N 2030/326
See application file for complete search history.

(56) References Cited

U.S. PATENT DOCUMENTS

| | | | | |
|---|---|---|---|---|
| 9,360,006 | B2 | 6/2016 | Herzog | |
| 10,514,028 | B2 * | 12/2019 | Imamura | F04B 49/065 |
| 2004/0164013 | A1 * | 8/2004 | Takao | F04B 11/0075 210/101 |
| 2007/0084766 | A1 * | 4/2007 | Ishii | G01N 30/32 210/87 |
| 2013/0104631 | A1 * | 5/2013 | Tokuo | G01N 30/02 73/61.56 |
| 2013/0336803 | A1 | 12/2013 | Ruegenberg | |
| 2014/0193275 | A1 | 7/2014 | Strobl | |
| 2018/0245581 | A1 * | 8/2018 | Imamura | F04B 11/0058 |

OTHER PUBLICATIONS

International Written Opinion for corresponding Application No. PCT/JP2017/027525, dated Oct. 24, 2017.

* cited by examiner

LIQUID DELIVERY DEVICE

TECHNICAL FIELD

The present invention relates to a liquid feeding device used to feed a mobile phase in a liquid chromatograph, such as a high performance liquid chromatograph (HPLC) or a supercritical fluid chromatograph (SFC).

BACKGROUND ART

The liquid feeding device used in an HPLC system is required to have the ability to stably feed a mobile phase at high pressure. For this reason, a liquid feeding device of a double plunger system in which two plunger pumps are connected in series or in parallel is generally used.

As an example, in the liquid feeding device in which two plunger pumps are connected in series, a primary plunger pump on an upstream and a secondary plunger pump on a downstream operate in a complementary manner. As a discharge process of the plunger pumps, there are a liquid feeding process by the primary plunger pump and a liquid feeding process by the secondary plunger pump.

In the discharge process by the primary plunger pump, the secondary plunger pump performs a suction operation while the primary plunger pump discharges liquid, and part of the liquid discharged by the primary plunger pump is sucked by the secondary plunger pump. In the discharge process by the secondary plunger pump, the secondary plunger pump performs a discharge operation, and, during the discharge operation, the primary plunger pump performs a suction operation.

In the discharge process by the primary plunger pump, a flow rate obtained by subtracting a suction flow rate of the secondary plunger pump from a discharge flow rate of the primary plunger pump is a feeding flow rate of the liquid feeding device. In the discharge process by the secondary plunger pump, the discharge flow rate of the secondary plunger pump is a feeding flow rate of the liquid feeding device.

Such a liquid feeding device of a series double plunger system is provided with a valve for preventing backflow on each of an inlet side and an outlet side of the primary plunger pump. When the primary plunger pump performs the discharge operation, the valve on the inlet side closes and the valve on the outlet side opens, and when the primary plunger pump performs the suction operation, the valve on the inlet side opens and the valve on the outlet side closes.

Since the suction operation of the primary plunger pump is performed in a state where the valve on the outlet side is closed, pressure in a pump chamber of the primary plunger pump after the suction operation of the primary plunger pump is completed is in a state of being lower than system pressure (pressure in an analysis channel of an HPLC or an SFC). When, in this state, the pump that performs discharge operation is switched from the secondary plunger pump to the primary plunger pump, liquid is not discharged from the primary plunger pump until pressure in a pump chamber of the primary plunger pump increases to the same pressure as the system pressure. As a result, the feeding flow rate is temporarily lowered and stability of the feeding flow rate is lowered.

Due to the above problem, during the discharge process by the secondary plunger pump, the primary plunger pump generally performs pre-compression operation to drive a plunger in a discharge direction so that pressure in a pump chamber can be increased to pressure close to the system pressure, in addition to the suction operation of liquid.

The above similarly applies to a liquid feeding device of a parallel double plunger system in which two plunger pumps are connected in parallel, and while one plunger pump is performing discharge operation, the other plunger pump performs suction operation and pre-compression operation.

When the pre-compression operation is performed, a mobile phase sucked into a pump chamber is compressed to generate heat, a temperature of the mobile phase increases, and the volume is expanded. After the above, in a process of flowing through a channel, the mobile phase discharged from the pump chamber is deprived of heat by a channel wall surface and the like to be cooled, and the volume shrinks. When such volumetric shrinkage occurs, a difference between an actual feeding flow rate and an ideal value of a feeding flow rate obtained by the product of a plunger cross-sectional area and a driving speed of the plunger, which causes lowering in liquid feeding accuracy and pulsation.

As a solution to the above problems due to volumetric shrinkage of the mobile phase, performing feedforward control for controlling a plunger speed based on prior knowledge of heat generation and cooling processes of the mobile phase, and feedback control for controlling a plunger speed so that system pressure becomes equal to a target value has been proposed (see Patent Documents 1 to 5). These types of control are collectively referred to as thermal compensation control.

PRIOR ART DOCUMENTS

Patent Documents

Patent Document 1: U.S. Pat. No. 8,535,016B2
Patent Document 2: U.S. Pat. No. 9,360,006B2
Patent Document 3: U.S. Pat. No. 8,297,936B2
Patent Document 4: US2014193275A1
Patent Document 5: US2013336803A1
Patent Document 6: WO2017/094097

SUMMARY OF THE INVENTION

Problems to be Solved by the Invention

Theoretically, the thermal compensation control as described above can suppress the occurrence of problems, such as a lowering in liquid feeding accuracy and pulsation. In practice, however, pulsation that cannot be ignored may occur even when the thermal compensation control is performed.

In the first place, a volume change of the mobile phase in the liquid feeding process that is a cause of pulsation is caused by the fact that the mobile phase that generates heat in a pre-compression process is discharged from the pump chamber while the mobile phase remains in a state where the temperature is increased. Therefore, if the increase in temperature of the mobile phase in the pre-compression process can be suppressed, pulsation is also suppressed.

In view of the above, an object of the present invention is to allow suppression of temperature increase in liquid to be fed in a pre-compression process of a liquid feeding device.

Solutions to the Problems

The present inventors have placed a focus on a relationship between the speed of discharge operation of a plunger pump during a pre-compression process (which will be referred to as the pre-compression speed) and the magnitude of heat generation of liquid to be fed. In a case where the pre-compression speed is low, heat generation of liquid is sufficiently absorbed by a pump head during the pre-compression process. Since the pre-compression process is performed isothermally, a temperature increase range of the liquid is small, and the volume change of the liquid during the liquid feeding process is also small. As a result, pulsation is suppressed. Note that a time constant for heat generation to be absorbed by the pump head is on the order of 1 s to several seconds.

In contrast, in a case where the pre-compression speed is high, heat generation of liquid is not sufficiently absorbed by the pump head during the pre-compression process. That is, since the pre-compression process is performed adiabatically, a temperature increase range of the liquid is large, and the volume change of the liquid during the liquid feeding process is also large. As a result, a relatively large pulsation occurs.

Therefore, making the pre-compression speed as low as possible enables suppression of the temperature increase in the liquid to be fed and suppression of the occurrence of pulsation. However, reducing the pre-compression speed as much as possible to bring the pre-compression process closer to an isothermal process cannot be easily realized. This is because of restrictions described below.

As a first restriction, there is a restriction due to a system pressure (also referred to as a feeding pressure). In the liquid chromatograph, the system pressure can take a wide range of values from several MPa to over 100 MPa. A discharge operation amount of the plunger pump required until the pre-compression process is completed, that is, a moving distance (pre-compression distance) of the plunger is proportional to the system pressure. When the system pressure is high, the pre-compression distance becomes long. Therefore, in order to complete the pre-compression process before the plunger pump makes a transition to the discharge process, the pre-compression speed needs to be increased to some extent. However, such a high pre-compression speed becomes excessive when the system pressure is low, and the pre-compression process is completed in a shorter time than necessary. As a result, the pre-compression process may be adiabatic.

As a second restriction, there is a restriction due to the compressivity of the liquid to be fed. The pre-compression distance is proportional to the compressivity of the liquid to be fed. In water and an organic solvent used as a mobile phase in a liquid chromatograph, the organic solvent has a higher compressivity than water, and the compressivity difference is about three times. For this reason, in a case where the liquid to be fed is an organic solvent, the pre-compression distance becomes long as compared to a case where the liquid to be fed is water. Thus, if the pre-compression speed is set based on liquid having a high compressivity, the pre-compression speed is excessive for liquid having a lower compressivity, and the pre-compression process is completed in a shorter time than necessary. As a result, the pre-compression process may be adiabatic.

As a third restriction, in a case where a plunger pump is performing a pre-compression process, there is a temporal restriction that the pre-compression process must be completed by a time the discharge process of another plunger pump is completed and the plunger pump makes a transition to the discharge process. An operating distance of the plunger is limited, and the plunger cannot be operated beyond a top dead center (a position where the plunger is pushed most into the pump chamber). For this reason, the pre-compression process must be completed before the plunger of the plunger pump during the discharge process reaches the top dead center (or a deceleration start reference point provided slightly before the top dead center to secure a deceleration distance). In a case where the plunger of the plunger pump during the discharge process is close to the top dead center, the time of which the plunger pump during the pre-compression process makes a transition to the discharge process is close, and a pre-compression speed that is high to some extent is required to complete the pre-compression process quickly. However, in a case where the plunger of the plunger pump during the discharge process is still far from the top dead center, such a high pre-compression speed is excessive, and the pre-compression process is completed in a shorter time than necessary. As a result, the pre-compression process may be adiabatic.

As a fourth restriction, there is a restriction due to a feeding flow rate. In a liquid chromatograph and a supercritical fluid chromatograph, the feeding flow rate may take a wide range of values from several uL/min to several mL/min. In a liquid feeding device of the double plunger system, the cycle of switching the plunger pump that executes the discharge process (which is referred to as the pump cycle) is inversely proportional to the feeding flow rate, and therefore, the pump cycle has a range of about 3 digits in the above flow rate range. In a case where the feeding flow rate is high, the pump cycle may be 1 s or less, and the time that can be allocated to the pre-compression process is shortened. For this reason, it is necessary to increase the pre-compression speed to some extent. However, such a high pre-compression speed becomes excessive when the feeding flow rate is low, and the pre-compression process is completed in a shorter time than necessary. As a result, the pre-compression process may be adiabatic.

Here, Patent Document 6 describes that a time (which is referred to as the pre-compression time) spent on a pre-compression process based on a set flow rate (target feeding flow rate) is obtained, and the pre-compression speed is determined so that pre-pressuring is completed within the pre-compression time. Therefore, if the technique disclosed in Patent Document 6 is used, it is considered possible to configure a liquid feeding device that meets the fourth restriction. However, Patent Document 6 does not describe anything about suppressing the temperature increase in the liquid during the pre-compression process, and does not describe or suggest the first, second, or third restrictions. Therefore, even if a person skilled in the art knows the existence of Patent Document 6, it is impossible to configure a liquid feeding device that complies with the first, second, and third restrictions.

The liquid feeding device according to the present invention has first to third aspects corresponding to the first to third restrictions, respectively. Each of the first to third aspects includes a discharge channel, a pump part, a feeding pressure sensor, a non-discharge pressure sensor, a pre-compression part, and a pre-compression speed determination part.

The pump part has a plurality of plunger pumps connected in series or in parallel to each other, and discharges the liquid to be fed into the discharge channel. At least one of a plurality of the plunger pumps is a closed pump which is not connected to the discharge channel during a non-discharge time, the non-discharge time is a time in which the closed pump does not execute a discharge process for discharging liquid to the discharge channel. In a case where the liquid feeding device of the present invention is of a series double plunger system in which two plunger pumps are connected in series, a plunger pump on the primary (upstream) corresponds to the closed pump. Further, in a case where the liquid feeding device of the present invention is of a parallel double plunger system in which two plunger pumps are connected in parallel, both the plunger pumps correspond to the closed pump. In the closed pump in which communication with the discharge channel is disconnected during the non-discharge time, the pressure in the pump chamber after the suction process is completed is lower than the pressure in the discharge channel (for example, atmospheric pressure). For this reason, the closed pump needs to execute the pre-compression process to increase the pressure in the pump chamber to the pressure in the discharge channel, that is, to the pressure to the same extent as the feeding pressure, before making a transition to the discharge process after the suction process is completed.

The feeding pressure sensor detects the pressure in the discharge channel as the feeding pressure. The non-discharge pressure sensor detects the pressure in the pump chamber of the closed pump during the non-discharge time as the non-discharge pressure.

The pre-compression part is configured to cause the closed pump to execute a pre-compression process after completing a suction process for sucking liquid into the pump chamber and during the non-discharge time based on output of the feeding pressure sensor and output of the non-discharge pressure sensor. The pre-compression process is a process to perform a discharge operation until the non-discharge pressure reaches substantially the same as the feeding pressure. Whether or not the non-discharge pressure is substantially the same as the feeding pressure can be determined, for example, based on whether or not a difference between the non-discharge pressure and the feeding pressure is within a predetermined range.

The pre-compression speed determination part is configured to determine a speed of the discharge operation of the closed pump in the pre-compression process, that is, the pre-compression speed. The pre-compression part is configured to operate the closed pump at the pre-compression speed determined by the pre-compression speed determination part in the pre-compression process.

The first aspect of the liquid feeding device according to the present invention corresponds to the first restriction described above. That is, in the first aspect, the pre-compression speed determination part is configured to determine the pre-compression speed based on the feeding pressure and based on a correlation specified so that the maximum speed of the discharge operation of the closed pump in the pre-compression process (hereinafter referred to as the maximum pre-compression speed) becomes higher as the feeding pressure is larger.

In the first aspect, the pre-compression part is preferably configured to cause the closed pump to start the pre-compression process immediately after the suction process of the closed pump is completed, and the pre-compression speed determination part is preferably configured to determine a speed of discharge operation of the closed pump during the pre-compression process so that the pre-compression process of the closed pump is completed immediately before the discharge process of another plunger pump during the discharge process is finished. In such a manner, the pre-compression process can be performed for as long as possible, so that the pre-compression process performed adiabatically due to reduction in the pre-compression speed can be suppressed.

Further, in the first aspect, the correlation is preferably specified so that a speed of discharge operation of the closed pump in the pre-compression process becomes higher as a difference between the feeding pressure and the non-discharge pressure is larger. In such a case, the pre-compression speed determination part is configured to determine a new speed of discharge operation of the closed pump, while the closed pump is performing the pre-compression process, using the correlation, and the pre-compression part is configured to change a speed of discharge operation of the closed pump to the new speed when the new speed of discharge operation of the closed pump is determined by the pre-compression speed determination part. In this manner, the pre-compression speed of the plunger pump during the pre-compression process can be set according to the difference between the feeding pressure and the non-discharge pressure.

Furthermore, the first aspect can also be made to correspond to the fourth restriction described above. That is, the correlation can be specified so that a maximum speed of discharge operation of the closed pump in the pre-compression process becomes higher as the target feeding flow rate is higher. In this manner, the pre-compression speed of the plunger pump during the pre-compression process can be set according to the preset target feeding flow rate.

Further, the first aspect can also be made to correspond to the second restriction described above. In such a case, a compressivity storage part that stores information regarding compressivity of liquid to be fed is further included, and the correlation is specified so that a maximum speed of discharge operation of the closed pump in the pre-compression process becomes higher as the compressivity of liquid to be fed is higher. In this manner, the pre-compression speed of the plunger pump during the pre-compression process can be set according to the compressivity of the liquid to be fed.

Further, the first aspect can also be made to correspond to the third restriction described above. That is, a possible discharge operation amount calculation part configured to calculate a possible discharge operation amount may be further included. The possible discharge operation amount is an amount that the plunger pump, which is in the discharge process at the time when the pre-compression process of the closed pump is started, can perform the discharge operation before the plunger pump reaches a top dead center or a deceleration start reference point set at a position where is slightly before the top dead center. In this case, the correlation may be specified so that a maximum speed of discharge operation during the pre-compression process of the closed pump becomes lower as the possible discharge operation amount is larger. In this manner, the pre-compression speed of the plunger pump during the pre-compression process can be set according to a state of another plunger pump at the time of the discharge process.

The second aspect of the liquid feeding device according to the present invention corresponds to the second restriction described above. That is, the second aspect includes a compressivity storage part that stores information regarding the compressivity of liquid to be fed. Then, the pre-compression speed determination part is configured to determine a speed of discharge operation of the closed pump during the pre-compression process based on the compressivity of liquid to be fed and based on a correlation specified so that a maximum speed of the discharge operation during the pre-compression process of the closed pump becomes higher as the compressivity is higher. In this manner, the pre-compression speed of the plunger pump during the pre-compression process is set according to the compressivity of the liquid to be fed.

In the second aspect as well, the pre-compression part is preferably configured to cause the closed pump to start the pre-compression process immediately after the suction process of the closed pump is completed, and the pre-compression speed determination part is preferably configured to determine a speed of the discharge operation of the closed pump in the pre-compression process so that the pre-compression process of the closed pump is completed immediately before the discharge process of another plunger pump during the discharge process is finished. In such a manner, the pre-compression process can be performed for as long as possible, so that the pre-compression process performed adiabatically due to reduction in the pre-compression speed can be suppressed.

Further, the second aspect may also be made to correspond to the fourth restriction described above. That is, the correlation may be specified so that a maximum speed of the discharge operation of the closed pump in the pre-compression process becomes higher as the target feeding flow rate is higher. In this manner, the pre-compression speed of the plunger pump during the pre-compression process can be set according to the preset target feeding flow rate.

Further, the second aspect may also be made to correspond to the third restriction described above. That is, a possible discharge operation amount calculation part configured to calculate a possible discharge operation amount may be further included. The possible discharge operation amount is an amount that the plunger pump, which is in the discharge process at the time when the pre-compression process of the closed pump is started, can perform the discharge operation before the plunger pump reaches a top dead center or a deceleration start reference point set at a position where is slightly before the top dead center. In this case, the correlation may be specified so that a maximum speed of discharge operation during the pre-compression process of the closed pump becomes lower as the possible discharge operation amount is larger. In this manner, the pre-compression speed of the plunger pump during the pre-compression process can be set according to a state of another plunger pump during the discharge process.

The third aspect of the liquid feeding device according to the present invention corresponds to the third restriction described above. That is, the third aspect further includes a possible discharge operation amount calculation part configured to calculate a possible discharge operation amount. The possible discharge operation amount is an amount that the plunger pump, which is in the discharge process at the time when the pre-compression process of the closed pump is started, can perform the discharge operation before the plunger pump reaches a top dead center or a deceleration start reference point set at a position where is slightly before the top dead center. Then, the pre-compression speed determination part is configured to determine a speed of discharge operation of the closed pump in the pre-compression process based on the possible discharge operation amount and based on a correlation specified so that a maximum speed of discharge operation of the closed pump in the pre-compression process becomes lower as the possible discharge operation amount is larger. In this manner, the pre-compression speed of the plunger pump during the pre-compression process is set according to a state of another plunger pump during the discharge process.

In the third aspect as well, the pre-compression part is preferably configured to cause the closed pump to start the pre-compression process immediately after the suction process of the closed pump is completed, and the pre-compression speed determination part is preferably configured to determine a speed of discharge operation of the closed pump in the pre-compression process so that the pre-compression process of the closed pump is completed immediately before the discharge process of another plunger pump during the discharge process is finished. In such a manner, the pre-compression process may be performed for as long as possible, so that the pre-compression process performed adiabatically due to reduction in the pre-compression speed can be suppressed.

Further, the third aspect may also be made to correspond to the fourth restriction described above. That is, the correlation can be specified so that a maximum speed of discharge operation of the closed pump in the pre-compression process becomes higher as the target feeding flow rate is higher. In this manner, the pre-compression speed of the plunger pump in the pre-compression process can be set according to the preset target feeding flow rate.

Effects of the Invention

In the first aspect of the liquid feeding device according to the present invention, the pre-compression speed determination part is configured to determine the pre-compression speed based on the feeding pressure and based on a correlation specified so that a maximum pre-compression speed of the closed pump in the pre-compression process becomes higher as the feeding pressure is higher.

Accordingly, the pre-compression speed of the closed pump is set according to the feeding pressure. In this manner, when the feeding pressure is low, the pre-compression speed is also lowered accordingly, so that the pre-compression process is easily performed isothermally, and the temperature increase of the liquid to be fed is suppressed in the pre-compression process.

In the second aspect of the liquid feeding device according to the present invention, the pre-compression speed of the closed pump in the pre-compression process is set according to the compressivity of the liquid to be fed. In this manner, when the compressivity of the liquid to be fed is low, the pre-compression speed is also lowered accordingly, so that the pre-compression process is easily performed isothermally, and the temperature increase of the liquid to be fed is suppressed in the pre-compression process.

In the third aspect of the liquid feeding device according to the present invention, the pre-compression speed of the plunger pump at the time of the pre-compression process is set according to a state of another plunger pump in the discharge process. In this manner, when another plunger pump, which is in the discharge process at the time when the closed pump starts the pre-compression process, is far from the top dead center or the deceleration start reference point which is set at a position where is slightly before the top dead center, the maximum pre-compression speed is also lowered accordingly, so that the pre-compression process is easily performed isothermally. As a result, the temperature increase of the liquid to be fed is suppressed in the pre-compression process.

EMBODIMENTS OF THE INVENTION

Hereinafter, an embodiment of the liquid feeding device according to the present invention will be described with reference to the drawings.

Figure 1:
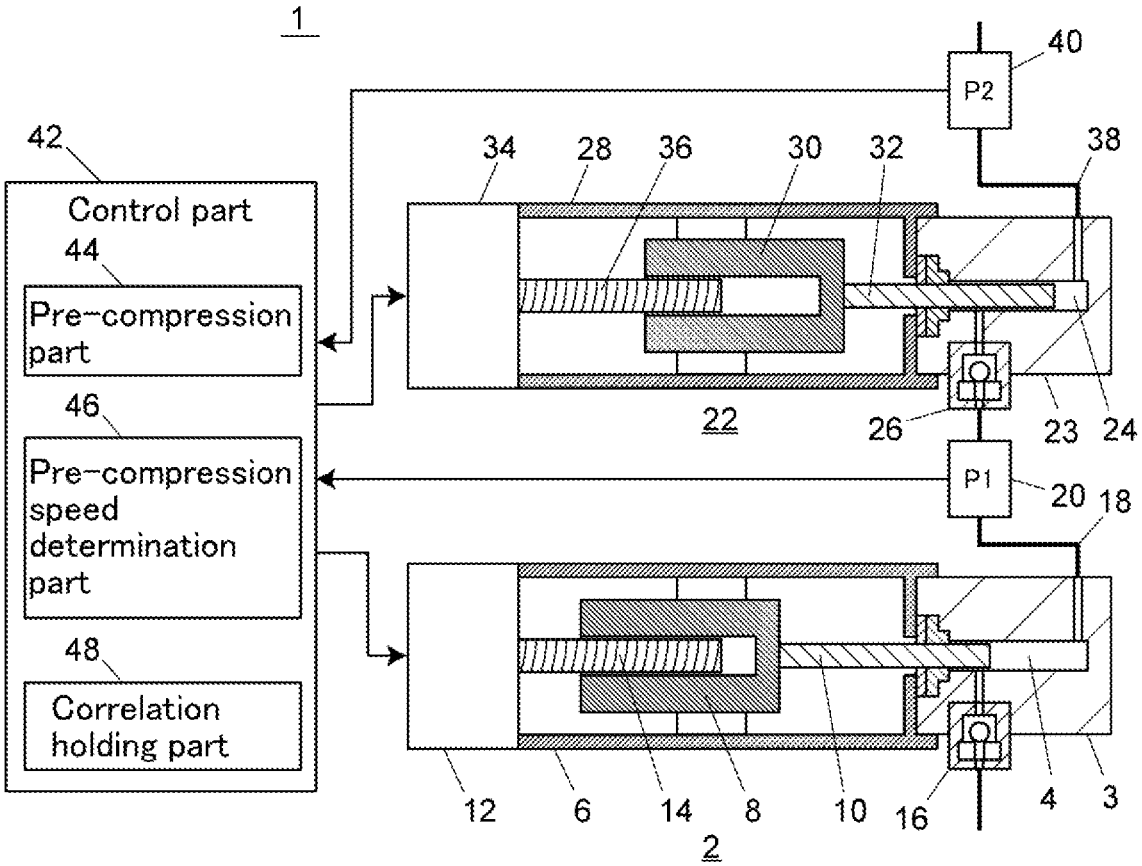
FIG. 1 is a schematic cross-sectional view showing an embodiment of a liquid feeding device.

The embodiment of the liquid feeding device will be described with reference to FIG. 1.

The liquid feeding device 1 of the embodiment includes two plunger pumps, that are, a primary pump 2 and a secondary pump 22. The primary pump 2 and the secondary pump 22 are connected in series with each other. The primary pump 2 and the secondary pump 22 constitute a pump part that feeds liquid through a discharge channel 38.

The primary pump 2 includes a pump head 3 having a pump chamber 4 in the inside and a pump body 6. The pump head 3 is provided at the tip of the pump body 6. The pump head 3 is provided with an inlet portion for allowing liquid to flow into the pump chamber 4 and an outlet portion for allowing liquid to flow out of the pump chamber 4. A check valve 16 that prevents back flow of liquid is provided at the inlet portion of the pump head 3.

The tip of a plunger 10 is slidably inserted into the pump chamber 4. A proximal end of the plunger 10 is held by a crosshead 8 accommodated in the pump body 6. The crosshead moves in one direction (left-right direction in the diagram) in the pump body 6 by rotation of a feed screw 14, and the plunger 10 moves in one direction accordingly. A primary pump drive motor 12 that rotates the feed screw 14 is provided at a proximal end portion of the pump body 6. The primary pump drive motor 12 is a stepping motor.

The second-side pump 22 includes a pump head 23 having a pump chamber 24 in the inside and a pump body 28. The pump head 23 is provided at the tip of the pump body 28. The pump head 23 is provided with an inlet portion for allowing liquid to flow into the pump chamber 24 and an outlet portion for allowing liquid to flow out of the pump chamber 24. A check valve 26 that prevents back flow of liquid is provided at the inlet portion of the pump head 23.

The tip of a plunger 32 is slidably inserted into the pump chamber 24. A proximal end of the plunger 32 is held by a crosshead 30 accommodated in the pump body 28. The crosshead 30 moves in one direction (left-right direction in the diagram) in the pump body 28 by rotation of a feed screw 36, and the plunger 32 moves in one direction accordingly. A secondary pump drive motor 34 that rotates the feed screw 36 is provided at a proximal end portion of the pump body 28. The secondary pump drive motor 34 is a stepping motor.

The inlet portion of the pump head 3 is connected, through a channel, to a container (not shown) for storing liquid to be fed. The inlet portion of the pump head 23 is connected to the outlet portion of the pump head 3 through a connection channel 18. A primary pressure sensor 20 for detecting pressure (P1) in the pump chamber 4 is provided on the connection channel 18. The primary pressure sensor 20 is for detecting the pressure in the pump chamber 4 of the primary pump 2 during a non-discharge time when the primary pump 2 is not in the discharge process as non-discharge pressure.

The discharge channel 38 is connected to the outlet portion of the pump head 23. The discharge channel 38 communicates with, for example, an analysis channel of a liquid chromatograph. A secondary pressure sensor 40 that detects pressure (P2) in the pump chamber 24 as a feeding pressure is provided on the discharge channel 38.

Operation of the primary pump drive motor 12 and the secondary pump drive motor 34 is controlled by a control part 42. The control part 42 is configured to operate the primary pump 2 and the secondary pump 22 in a complementary manner so that a flow rate of liquid fed through the discharge channel 38 becomes a preset target flow rate.

The complementary operation of the primary pump 2 and the secondary pump 22 will be described. While the primary pump 2 executes a discharge process for discharging liquid, the secondary pump 22 performs a suction process for sucking liquid, and part of the liquid discharged from the primary pump 2 is sucked into the pump chamber 24 of the secondary pump 22. When the suction process of the secondary pump 22 is completed, the secondary pump 22 makes a transition to the discharge process. At this time, the primary pump 2 makes a transition to the suction process, and after the suction process is completed, a pre-compression process is executed.

During the discharge process of the secondary pump 22, that is, during the non-discharge time of the primary pump 2 not in the discharge process, the check valve 26 is in a closed state. In this manner, the communication between the pump chamber 4 of the primary pump 2 and the discharge channel 38 is disconnected. The pump in which communication with the discharge channel 38 is disconnected during the non-discharge time as described above is referred to as a closed pump in the present application. Since the liquid feeding device of the embodiment is of a series double plunger system, only the primary pump 2 corresponds to the closed pump. However, in the case of a parallel double plunger system, both plunger pumps correspond to the closed pump.

Further, the non-discharge pressure P1 detected by the primary pressure sensor 20 and the feeding pressure P2 detected by the secondary pressure sensor 40 are taken into the control part 42. The control part 42 is configured to control operation of the primary pump drive motor 12 based on the non-discharge pressure P1 and on the feeding pressure P2 during a pre-compression process described later.

The control part 42 includes a pre-compression part 44, a pre-compression speed determination part 46, and a correlation holding part 48. The control part 42 is realized, for example, by a computer circuit having an arithmetic element, such as a microcomputer. The pre-compression part 44 and the pre-compression speed determination part 46 are functions obtained by the arithmetic element of the control part 42 executing a predetermined program, and the correlation holding part 48 is a function realized by a partial region of a storage device provided in the control part 42.

The pre-compression part 44 is configured to execute a pre-compression process on the primary pump 2 during the non-discharge time of the primary pump 2 not in the discharge process and after completion of the suction process for sucking liquid into the pump chamber 4. The pre-compression process is for causing the primary pump 2 to perform discharge operation until the non-discharge pressure P1 becomes substantially the same as the feeding pressure P2 at a timing before the primary pump 2 that has completed the suction process makes a transition to the discharge process. The timing at which the primary pump 2 starts the pre-compression process is, for example, immediately after the suction process of the primary pump 2 is completed.

The pre-compression speed determination part 46 is configured to determine a speed of the discharge operation of the primary pump 2 during the pre-compression process, that is, the pre-compression speed. The pre-compression speed determination part 46 determines the pre-compression speed of the primary pump 2 using the correlation held in the correlation holding part 48. The pre-compression part 44 operates the primary pump 2 at the pre-compression speed determined by the pre-compression speed determination part 46 in the pre-compression process.

Figure 2A:
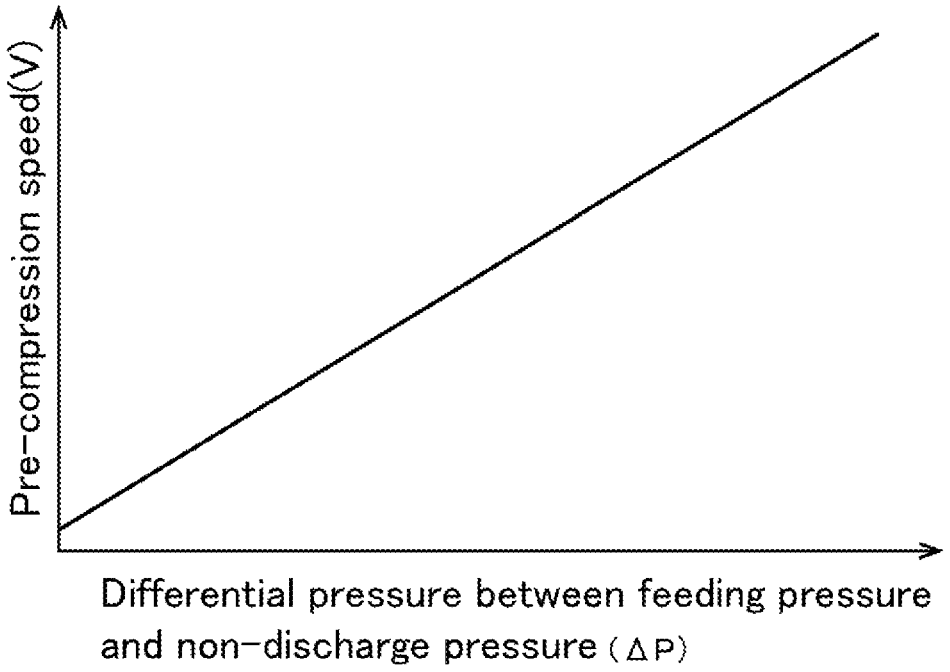
FIG. 2A is a graph showing an example of a correlation between a pre-compression speed and a feeding pressure used in the embodiment.
Figure 2B:
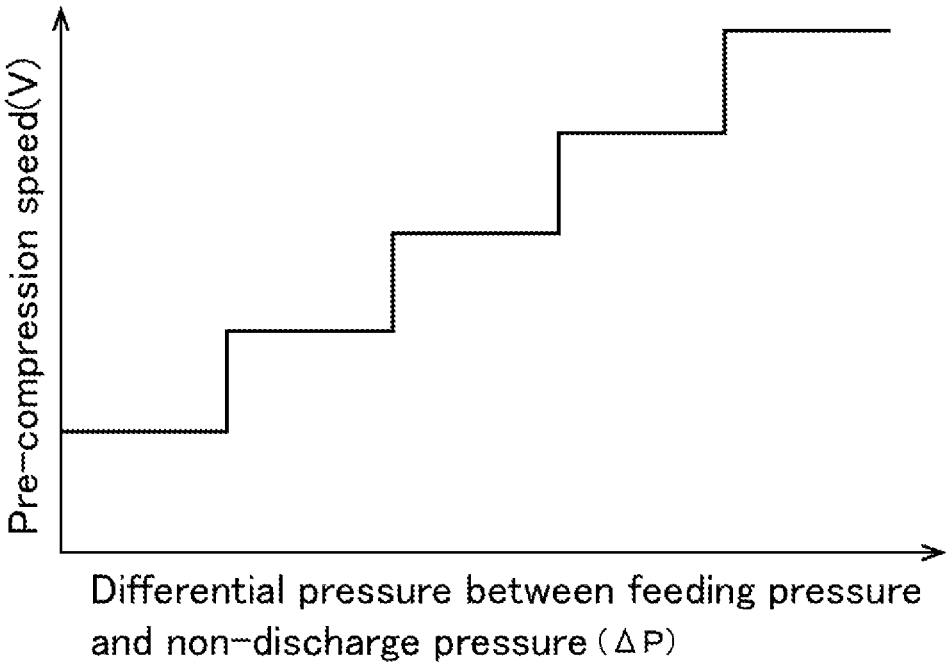
FIG. 2B is a graph showing another example of a correlation between the pre-compression speed and the feeding pressure used in the embodiment.

As shown in FIGS. 2A and 2B, as the correlation held in the correlation holding part 48, there is one that is specified so that a pre-compression speed V becomes higher as a differential pressure ΔP (=P2−P1) between the feeding pressure P2 and the non-discharge pressure P1 is larger. Note that, in FIG. 2A, the pre-compression speed V is drawn so regarding be linearly proportional to the differential pressure ΔP. However, the correlation may be drawn as a curve. Further, in FIG. 2B, the correlation is drawn in a stepwise manner and the differential pressure ΔP is divided into a plurality of levels, and the correlation specifies that the pre-compression speed V is determined by the level to which the differential pressure ΔP belongs. Note that the present invention is not limited to the above as long as the pre-compression speed V and the differential pressure ΔP have a positive correlation.

In a case where the pre-compression speed V is calculated using the correlation shown in FIG. 2A, the pre-compression speed V can be obtained by the following equation:

$$V = C1 \times \Delta P$$

where C1 is a proportionality coefficient set so that the pre-compression process is completed before the discharge process of the secondary pump 22 is finished.

The pre-compression speed determination part 46 determines an initial value of the pre-compression speed V using the above correlation, and may cause the primary pump to be operated at a constant speed during the pre-compression process, or may obtain the differential pressure ΔP at regular intervals and, each time the differential pressure ΔP is obtained, determine the pre-compression speed V again using the obtained ΔP and the above correlation. In a case where the pre-compression speed V is determined again during the pre-compression process, the pre-compression part 44 changes the pre-compression speed of the primary pump 2 to the re-determined speed.

Figure 3A:
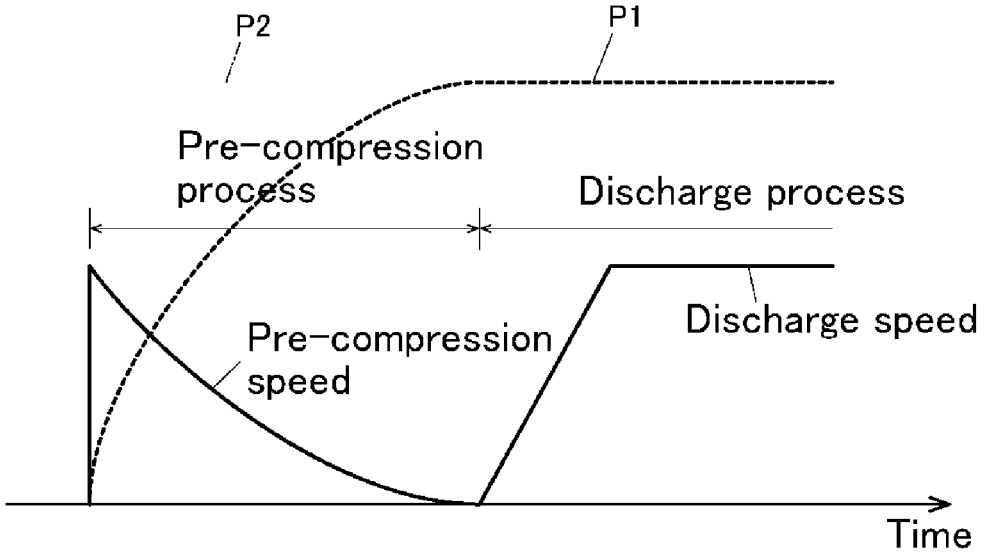
FIG. 3A is a graph showing a speed of pre-compression operation and discharge operation of a primary pump when the correlation of FIG. 2A is used, and a pressure P1 in a pump chamber of the primary pump at that time.
Figure 3B:
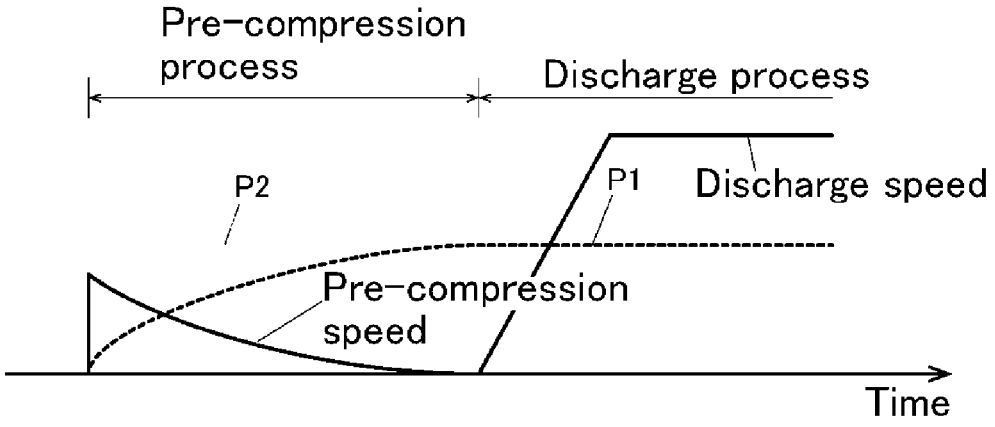
FIG. 3B is a graph showing a speed of the pre-compression operation and the discharge operation of the primary pump in a case where a feeding pressure P2 is lower than that in FIG. 3A, and the pressure P1 in the pump chamber of the primary pump at that time.

In a case where the initial value of the pre-compression speed V is determined using the above correlation, the differential pressure ΔP is obtained at regular intervals, and, each time the differential pressure ΔP is obtained, the pre-compression speed V is determined again using the obtained ΔP and the above correlation, the pre-compression speed V changes with time so regarding be continuously decreased with the initial value as the maximum speed as shown in FIGS. 3A and 3B. By the above operation, the initial value (maximum speed) of the pre-compression speed V is large when the feeding pressure P2 is high (see FIG. 3A), and the initial value of the pre-compression speed V is small when the feeding pressure P2 is low (see FIG. 3B). In this manner, the time required for the pre-compression process can be kept substantially constant regardless of the feeding pressure, so that the pre-compression process is more likely to be performed isothermally.

Further, by the above operation, since the pre-compression speed V is relatively high immediately after the pre-compression process is started, liquid is compressed in an adiabatic manner, and the liquid generates heat. However, this generated heat can be partially absorbed by the pump head 3 until the pre-compression process is completed by taking a long time for the pre-compression process, and the compression of the liquid can be made closer to an isothermal one. Further, since the pre-compression speed V continuously decreases with time, the heat generation of the liquid is also reduced with time, and the compression of the liquid becomes isothermal when the pre-compression process is completed. This makes the entire pre-compression process isothermal.

Another advantage of re-determining the pre-compression speed V during the pre-compression process is that a change in the feeding pressure P2 can be followed. In this manner, in a case where liquid feeding is performed under a liquid feeding condition, such as gradient analysis, where the feeding pressure P2 changes, the stability of the liquid feeding can be further improved.

Further, as shown in FIG. 2A, the correlation between the pre-compression speed V and the differential pressure ΔP is preferably specified so that the pre-compression speed does not become zero even when the differential pressure ΔP is zero or close to zero. In this manner, even in a case where the pre-compression process proceeds and the differential pressure ΔP becomes zero or close to zero, the pre-compression of the primary pump 2 is ensured to be completed within a finite time.

Figure 4A:
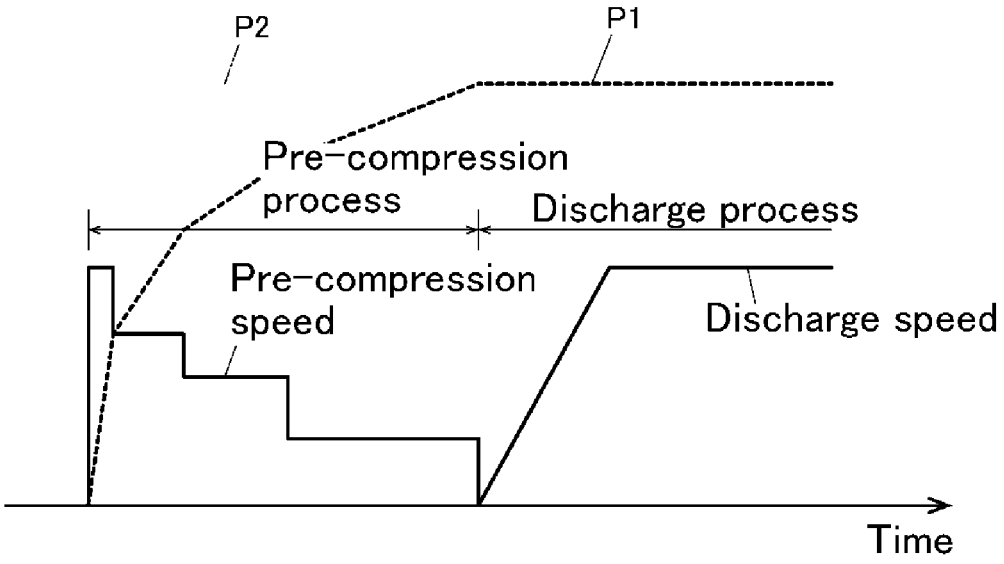
FIG. 4A is a graph showing a speed of the pre-compression operation and the discharge operation of the primary pump when the correlation of FIG. 2B is used, and the pressure P1 in the pump chamber of the primary pump at that time.
Figure 4B:
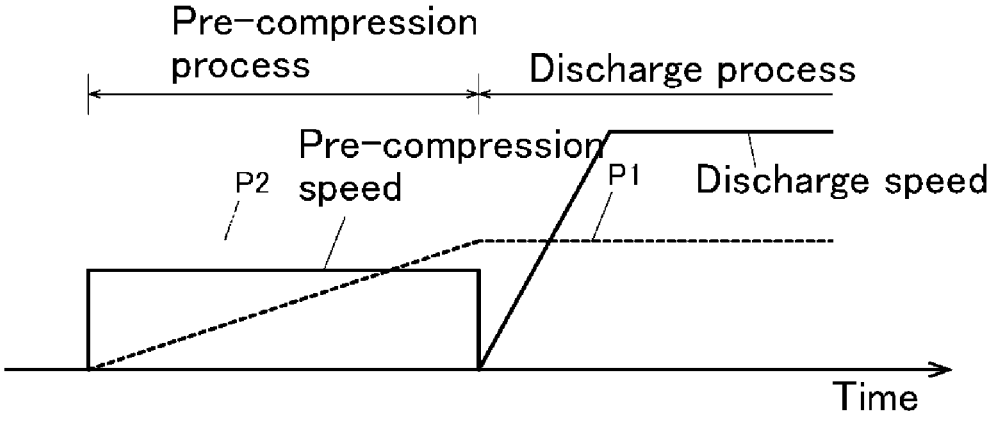
FIG. 4B is a graph showing a speed of the pre-compression operation and the discharge operation of the primary pump in a case where the feeding pressure P2 is lower than that in FIG. 4A, and the pressure P1 in the pump chamber of the primary pump at that time.

Further, if, as a correlation between the pre-compression speed V and the differential pressure ΔP, one that is drawn in a stepwise manner as shown in FIG. 2B is used and the pre-compression speed V is re-determined using the correlation at regular intervals, when the feeding pressure P2 takes a high value to some extent, the pre-compression speed V gradually decreases from the initial value as the maximum speed as shown in FIG. 4A. On the other hand, when the feeding pressure P2 takes a low value in such a way that the initial value of the pre-compression speed V is set to a minimum degree, the pre-compression speed V changes while being kept at the minimum degree. Even by the above operation, the initial value (maximum speed) of the pre-compression speed V is large when the feeding pressure P2 is high (see FIG. 4A), and the initial value of the pre-compression speed V is small when the feeding pressure P2 is low (see FIG. 4B). In this manner, the time required for the pre-compression process can be kept substantially constant regardless of the feeding pressure, so that the pre-compression process is more likely to be performed isothermally.

Figure 5:
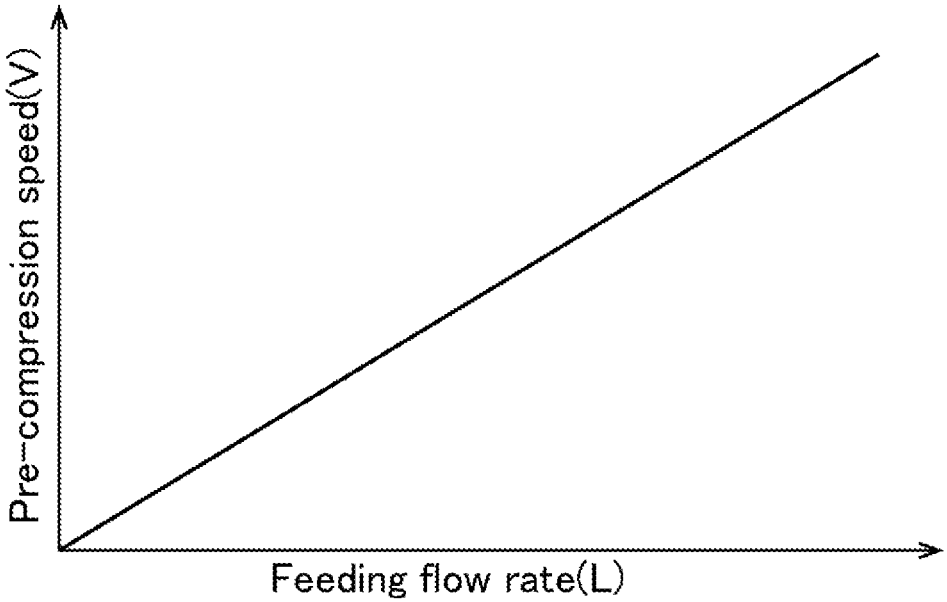
FIG. 5 is a graph showing an example of a correlation between the pre-compression speed and the feeding flow rate used in the embodiment.

Further, the pre-compression speed V can be correlated with a feeding flow rate L. FIG. 5 shows an example of a correlation between the pre-compression speed V and the feeding flow rate L. FIG. 5 shows a correlation in which the pre-compression speed V is linearly proportional to the feeding flow rate L. However, the present invention is not limited to the above as long as the pre-compression speed V and the feeding flow rate L have a positive correlation. Therefore, the correlation may be drawn in a curved manner or in a stepwise manner. Note that the feeding flow rate L is a preset target flow rate.

When the feeding flow rate L is large, the speed of the discharge operation of the secondary pump 22 is high, and therefore, the time allocated to the pre-compression process of the primary pump 2 is shortened. In contrast, when the feeding flow rate L is relatively small, the operating speed of the secondary pump 22 becomes slow, so that the time allocated to the pre-compression process of the primary pump 2 can be made relatively long. That is, when the feeding flow rate L is small, the pre-compression speed V can also be lowered, and the pre-compression process can be performed more isothermally.

In a case where the pre-compression speed V is correlated with a differential pressure ΔV and the feeding flow rate L, a correlation equation of the case can be expressed as follows:

$$V=C2\times\Delta P\times L$$

where C2 is a proportionality coefficient set so that the pre-compression process is completed before the discharge process of the secondary pump 22 is finished.

Figure 6:
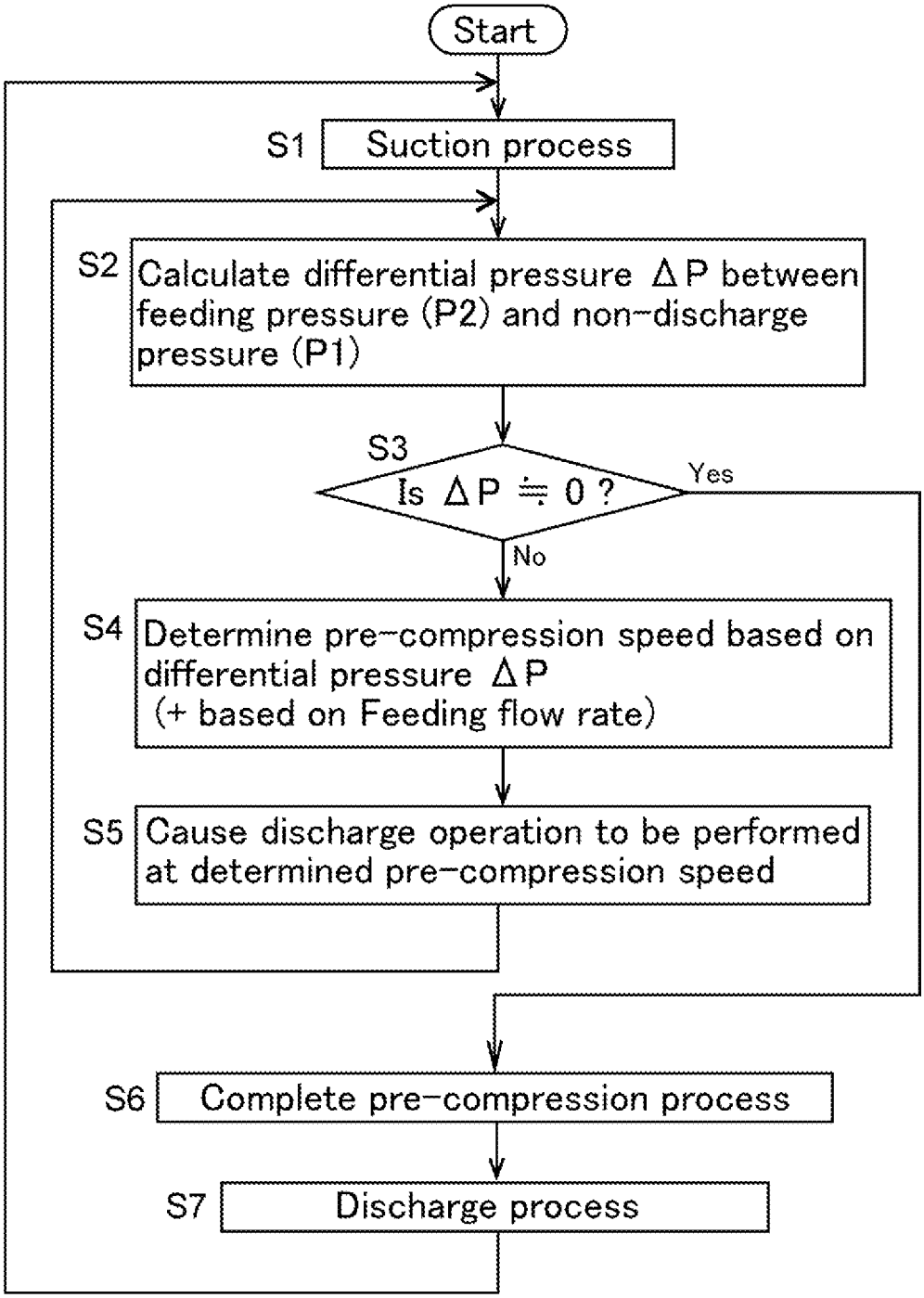
FIG. 6 is a flowchart showing an example of liquid feeding operation of the primary pump of the embodiment.

An example of the liquid feeding operation of the primary pump 2 in the embodiment will be described with reference to a flowchart of FIG. 6 together with FIG. 1. Here, a case where the pre-compression speed during the pre-compression process is changed with time will be described.

The primary pump 2 performs the suction process for sucking liquid into the pump chamber 4 (Step S1). In this suction process, the plunger 10 is driven to the suction side (left side in FIG. 1) at a high speed (for example, the maximum speed), so that the suction process is completed in a short time. This is to make the time allocated for the subsequent pre-compression process longer.

After the suction process of the primary pump 2 is completed, the pre-compression part 44 immediately causes the primary pump 2 to execute the pre-compression process. At this time, the pre-compression speed determination part calculates the differential pressure ΔP between the feeding pressure P2 and the non-discharge pressure P1 (Step S2). In a case where the differential pressure ΔP is not zero or substantially zero (Step S3), the pre-compression speed determination part 46 determines the pre-compression speed by using the correlation held in the correlation holding part 48 and based on the differential pressure ΔP or the differential pressure ΔP and the feeding flow rate L (Step S4). The pre-compression part 44 causes the primary pump 2 to perform the discharge operation at the speed determined by the pre-compression speed determination part (Step S5).

The above operation is repeatedly executed until the differential pressure ΔP becomes zero or substantially zero (Steps S3 to S5). In this manner, as shown in FIGS. 3A and 3B, the pre-compression speed during the pre-compression process continuously decreases with time. The pre-compression process is completed when the differential pressure ΔP becomes zero or substantially zero (Step S6). After the above, the primary pump 2 makes a transition to the discharge process (Step S7).

Figure 7:
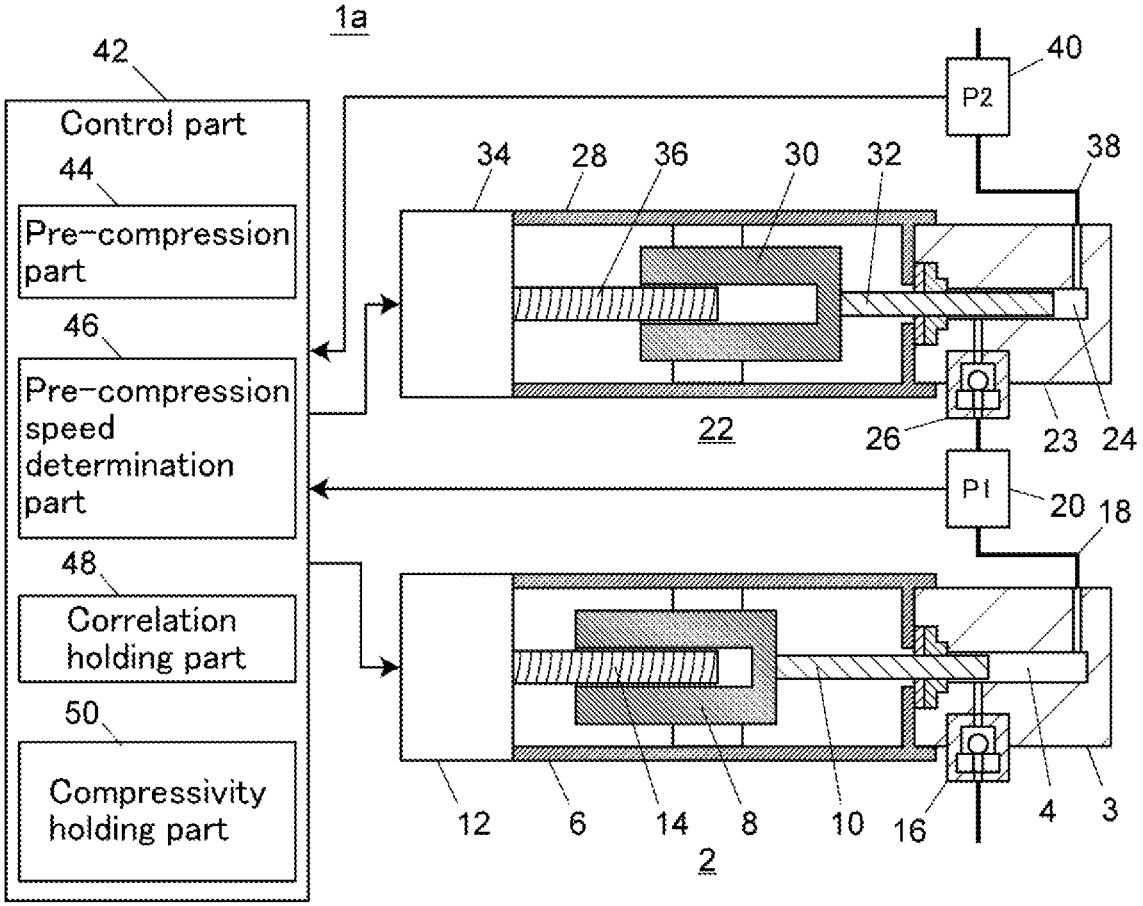
FIG. 7 is a schematic cross-sectional view showing another embodiment of the liquid feeding device.

Another embodiment of the liquid feeding device will be described with reference to FIG. 7.

The liquid feeding device 1 of the above embodiment and the liquid feeding device 1*a* of the present embodiment are different with respect to the point that the control part 42 includes a compressivity holding part 50, and the correlation holding part 48 holds a correlation between the pre-compression speed V and a compressivity k of the liquid to be fed. The compressivity holding part 50 is a function realized by a partial region of the storage device provided in the control part 42.

The compressivity holding part 50 is configured to hold the actual compressivity of the liquid to be fed or a predicted value of the compressivity. In a case where the compressivity of the liquid to be fed is known in advance, the actual compressivity input by the user can be held in the compressivity holding part 50. Further, the compressivity of the liquid to be fed can be obtained by calculation using an operation amount in the discharge direction of the plunger 10 during the pre-compression process of the primary pump 2 and an increase amount of the non-discharge pressure P1. Accordingly, the compressivity holding part 50 may hold the compressivity obtained by calculation during the pre-compression process one cycle before as a predicted value.

Figure 8:
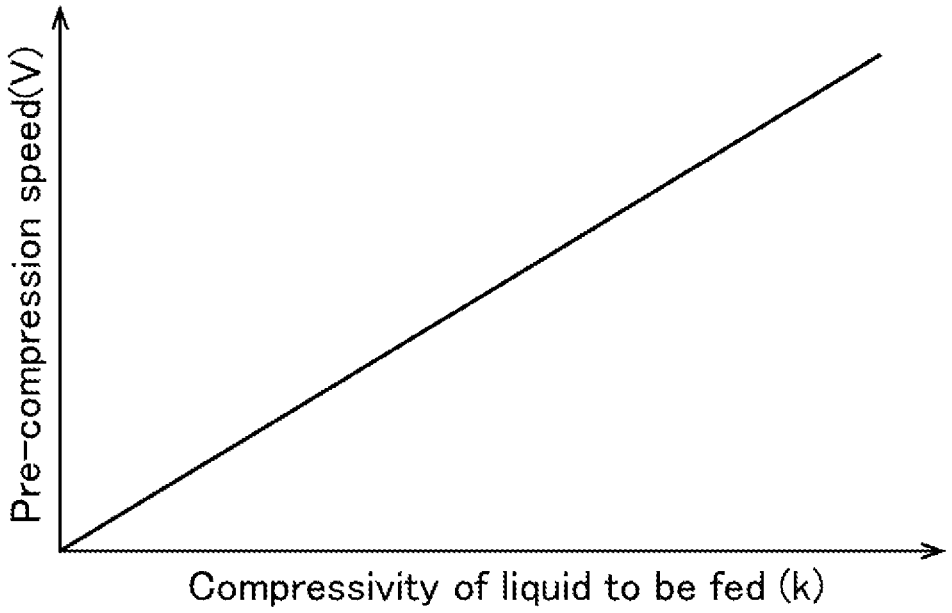
FIG. 8 is a graph showing an example of a correlation between the pre-compression speed and the compressivity used in the embodiment.

The correlation holding part 48 holds a correlation between the pre-compression speed V and the compressivity k of the liquid to be fed as shown in FIG. 8. This correlation is specified so that the pre-compression speed V is as high as the compressivity is large. That is, the pre-compression speed V and the compressivity k have a positive correlation. FIG. 8 shows a correlation in which the pre-compression speed V is linearly proportional to the compressivity k. However, the present invention is not limited to the above as long as the pre-compression speed V and the compressivity k have a positive correlation. Therefore, the correlation may be drawn in a curved manner or in a stepwise manner.

In the liquid feeding device 1*a* of the present embodiment, the pre-compression speed determination part 46 is configured to determine the pre-compression speed V using the correlation between the pre-compression speed V and the compressivity k in addition to the correlation between the pre-compression speed V and the differential pressure ΔP described above, or instead of the correlation between the pre-compression speed V and the differential pressure ΔP described above.

Since the pre-compression speed V is determined by using the correlation between the pre-compression speed V and the compressivity k, the pre-compression speed V becomes low when the compressivity k of the liquid to be fed is small, and the pre-compression speed becomes high when the compressivity k is large. In this manner, the pre-compression process can be completed in a similar length of time regardless of the compressivity of the liquid to be fed, so that the time required for the pre-compression process is not shortened more than necessary. In this manner, the compression of liquid in the pre-compression process is likely to become isothermal.

In a case where the pre-compression speed V is calculated using the correlation shown in FIG. 8, the pre-compression speed V can be obtained by the following equation:

$$V=C3\times k$$

where C3 is a proportionality coefficient set so that the pre-compression process is completed before the discharge process of the secondary pump 22 is finished.

Furthermore, in a case where the pre-compression speed V is correlated with the differential pressure ΔP and the compressivity k, a correlation equation for obtaining the pre-compression speed V is as follows:

$$V=C4\times\Delta P\times k$$

where C4 is a proportionality coefficient set so that the pre-compression process is completed before the discharge process of the secondary pump 22 is finished.

Furthermore, in a case where the pre-compression speed V is correlated with the differential pressure ΔP, the feeding flow rate L, and the compressivity k, a correlation equation for obtaining the pre-compression speed V is as follows:

$$V=C5\times\Delta P\times L\times k$$

where C5 is a proportionality coefficient set so that the pre-compression process is completed before the discharge process of the secondary pump 22 is finished.

Figure 9:
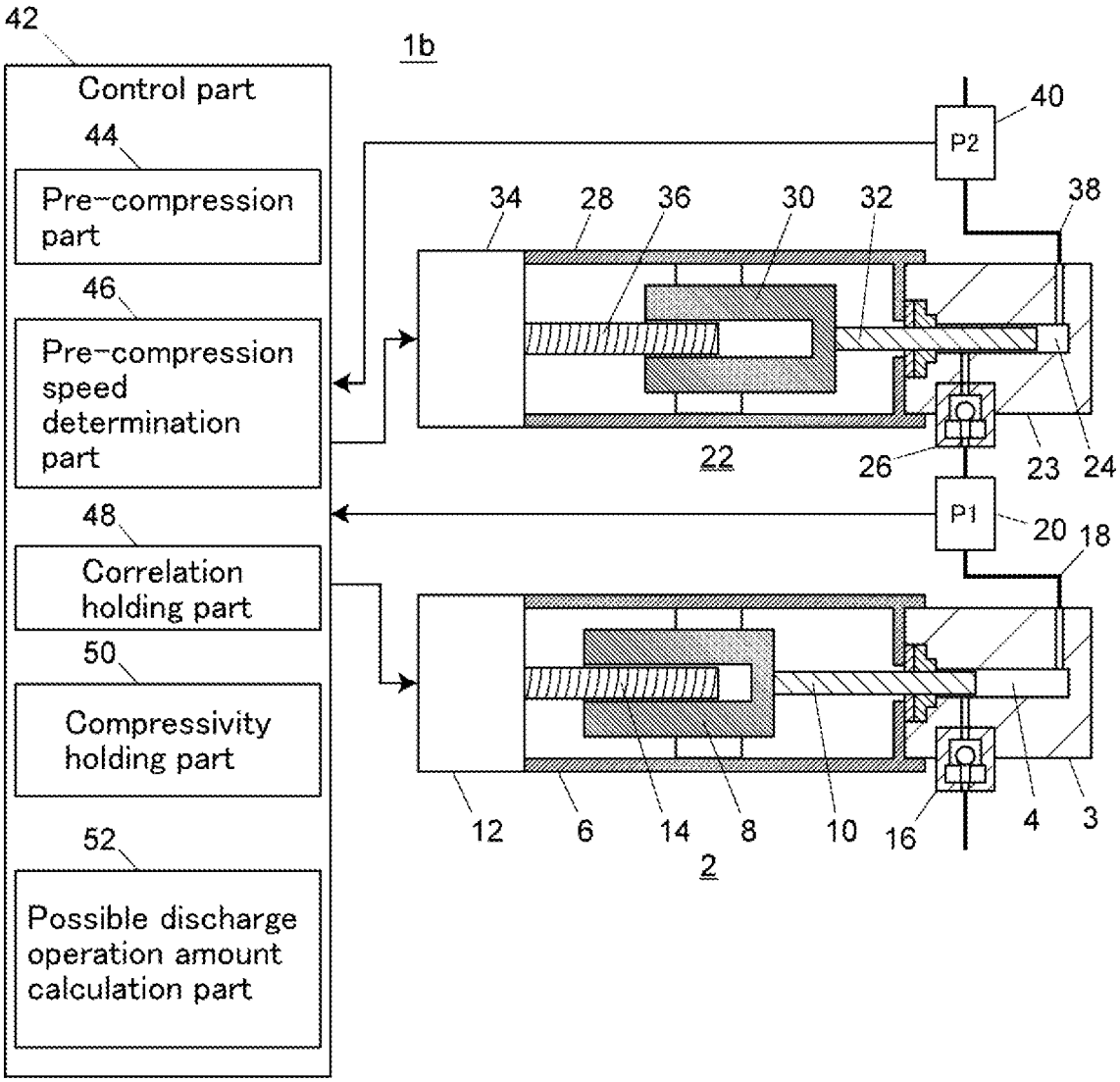
FIG. 9 is a schematic cross-sectional view showing still another embodiment of the liquid feeding device.

Still another embodiment of the liquid feeding device will be described with reference to FIG. 9.

The liquid feeding device 1*a* of the above embodiment and the liquid feeding device 1*b* of the present embodiment are different with respect to the point that the control part 42 includes a possible discharge operation amount calculation part 52, and the correlation holding part 48 holds a correlation between the pre-compression speed and the possible discharge operation amount calculation part 52. The possible discharge operation amount calculation part 52 is a function obtained when an arithmetic element of the control part 42 executes a predetermined program.

A relative relationship between a position of the plunger 10 of the primary pump 2 and a position of the plunger 32 of the secondary pump 22 is not always constant, and the position of each of the plungers 10 and 32 is affected by an operation history up to that time point. Accordingly, both a case where the position of the plunger 32 of the secondary pump 22 during the discharge process is far from the top dead center and a case where the position is close to the top dead center in a stage where the primary pump 2 starts the pre-compression process are assumed.

When the plunger 32 of the secondary pump 22 is far from the top dead center, a distance that the plunger 32 can be operated in the discharge direction until the plunger 32 reaches the top dead center (which is referred to as the possible discharge operation amount α) remains to be large. For this reason, a relatively long time can be allocated to the pre-compression process of the primary pump 2, and the pre-compression speed can be made relatively low. On the other hand, in a case where the plunger 32 of the secondary pump 22 is close to the top dead center, the possible discharge operation amount α is small. For this reason, the time allocated to the pre-compression process of the primary pump 2 is shortened, and the pre-compression speed needs to be made high.

The possible discharge operation amount α of the secondary pump 22 can be obtained by calculation on the control part 42 side. The control part 42 grasps the number of control pulses (referred to as the maximum number of control pulses) that can be given to the secondary pump drive motor 34 before the plunger 32 of the secondary pump 22 reaches the top dead center from the bottom dead center. For this reason, if the number of control pulses already given to the secondary pump drive motor 34 at the start of the pre-compression process of the primary pump 2 is subtracted from the maximum number of control pulses, the number of control pulses that can be given before the plunger 32 reaches top dead center, that is, the possible discharge operation amount α, can be obtained.

The calculation method for the possible discharge operation amount α described above can be slightly modified. When the feeding flow rate L is large, the operating speed of the plunger 32 of the secondary pump 22 is also large, and instantaneous stop and reverse at the top dead center may become difficult. In view of the above, a deceleration start reference point is set slightly before the top dead center, and when the plunger 32 of the secondary pump 22 reaches the deceleration start reference point, the operating speed may be gradually decreased, so that the operation is slowly stopped and reversed at the top dead center. In this case, the number of control pulses of the plunger 32 of the secondary pump 22 is subtracted from the number of pulses indicating the position of the deceleration start reference point, instead of the maximum number of control pulses indicating the position of the top dead center, so that the possible discharge operation amount α can be obtained. At this time, the plunger 10 of the primary pump 2 completes the pre-compression before the plunger 32 of the secondary pump 22 reaches the deceleration start reference point. Therefore, by causing the plunger 10 of the primary pump 2 to discharge while accelerating in accordance with the deceleration of the plunger 32 of the secondary pump 22, a desired feeding flow rate can be obtained in total.

Figure 10:
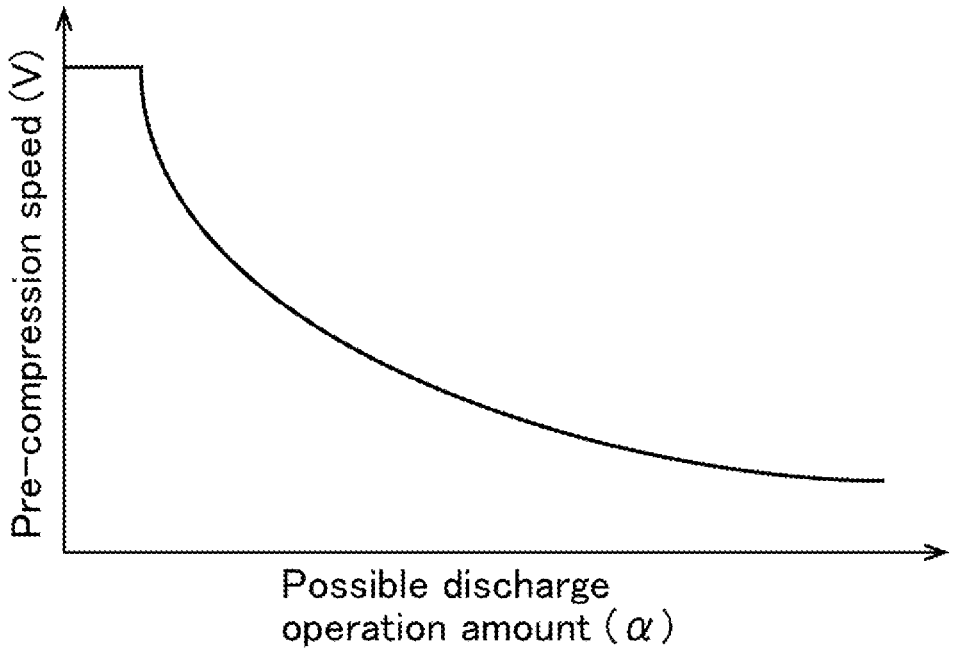
FIG. 10 is a graph showing an example of a correlation between the pre-compression speed and a possible discharge operation amount used in the embodiment.

As shown in FIG. 10, the correlation holding part 48 holds a correlation specified so that the pre-compression speed V becomes lower as the possible discharge operation amount α is larger. Note that, in FIG. 10, the pre-compression speed V is drawn so regarding be inversely proportional to the possible discharge operation amount α. However, the present invention is not limited to the above as long as the pre-compression speed V and the possible discharge operation amount α has a negative correlation. Therefore, the correlation may be drawn linearly or in a stepwise manner.

Note that, in the liquid feeding device 1*b* of the present embodiment, the pre-compression speed determination part 46 is configured to determine the pre-compression speed V using the correlation between the pre-compression speed V and the possible discharge operation amount α in addition to the correlation between the pre-compression speed V and the differential pressure ΔP and the correlation between the pre-compression speed V and the compressivity k described above, or instead of the correlation between the pre-compression speed V and the differential pressure ΔP and the correlation between the pre-compression speed V and the compressivity k described above.

When the pre-compression speed V is determined using the correlation shown in FIG. 10, the pre-compression speed V becomes high when the possible discharge operation amount α of the secondary pump 22 is small, and the pre-compression speed V becomes low when the possible discharge operation amount α is large. For this reason, the time required for the pre-compression process is not shortened more than necessary. In this manner, the compression of liquid in the pre-compression process is likely to become isothermal.

In a case where the pre-compression speed V is calculated using the correlation shown in FIG. 10, the pre-compression speed V can be obtained by the following equation:

$$V=C6/\alpha$$

where C6 is a proportionality coefficient set so that the pre-compression process is completed before the discharge process of the secondary pump 22 is finished.

Further, the pre-compression speed V can be correlated with all of the differential pressure ΔP, the feeding flow rate L, the compressivity k of liquid, and the pre-compression operation possible amount α. In this case, the pre-compression speed V can be obtained by following Equation (1):

$$V = C7 \times \frac{\Delta P \times L \times k}{\alpha} \tag{1}$$

where C7 is a mechanical constant determined by the design of the primary pump 2 and the secondary pump 22.

Description will be made on the fact that the time allocated to the pre-compression process is maximized by Equation (1) (and thus pre-compressiond most isothermally). The remaining time (remaining pre-compression time) until the pre-compression process of the primary pump 2 during the pre-compression process is completed can be obtained by following Equation (2):

$$\text{Remaining pre-pressure time} = C8 \times \frac{\Delta P \times k}{V} \tag{2}$$

where C8 is a mechanical constant determined by the design of the primary pump 2.

Further, the remaining time (remaining discharge time) until the discharge process of the secondary pump 22 during the discharge process at the same time is completed can be obtained by following Equation (3):

$$\text{Remaining discharge time} = C9 \times \frac{\alpha}{L} \tag{3}$$

where C9 is a mechanical constant determined by the design of the secondary pump 22.

In order for the primary pump 2 and the secondary pump 22 to cooperate and realize continuous liquid feeding, the primary pump 2 must complete the pre-compression process before the discharge process of the secondary pump 22 is finished. That is, there is the following restriction:

$$\text{Remaining discharge time} \geq \text{Remaining pre-compression time} \tag{4}$$

In order to perform the pre-compression process of the primary pump 2 more isothermally, the time allocated to the pre-compression process needs to be maximized. That is, $$\text{Remaining discharge time} = \text{Remaining pre-compression time} \tag{5}$$

is established. Therefore, above Equation (1) is obtained by substituting above Equations (2) and (3) into Equation (5).

Here, in a case where a predicted value obtained by calculation in advance is used as the compressivity k, there may be a case where there is a gap between the predicted value k and the actual compressivity of liquid. In such a case, a behavior such as one described below is realized.

In a case where the predicted value k of the compressivity is larger than the actual compressivity, the pre-compression speed is calculated to be large at the initial stage of the pre-compression process. For this reason, pressure of a mobile phase is increased faster than expected. If the pre-compression speed V is recalculated at this time, the remaining pre-compression pressure decreases faster than expected, so the recalculated pre-compression speed V becomes smaller. For this reason, a continuously decreasing pre-compression speed profile as shown in FIGS. 3A and 3B is obtained.

In contrast, in a case where the predicted value k of the compressivity is smaller than the actual compressivity, the pre-compression speed V is calculated to be small at the initial stage of the pre-compression process. For this reason, pressure of a mobile phase is increased slower than expected. If the pre-compression speed V is recalculated at this time, the remaining pre-compression pressure decreases slower than expected, so the recalculated pre-compression speed V becomes larger. For this reason, a continuously increasing speed profile is obtained in contrast to the continuously decreasing pre-compression speed profile as shown in FIGS. 3A and 3B.

In any case, the pre-compression process of the primary pump 2 is ensured to be completed within the remaining discharge time of the secondary pump 22. However, in order to suppress heat generation due to adiabatic compression of liquid during the pre-compression process, the pre-compression speed preferably decreases continuously with time as shown in FIGS. 3A and 3B. For this reason, a largest value in liquid used as the mobile phase may be used as the predicted value k so that the predicted value k of the compressivity of the liquid does not become smaller than the actual compressivity of the liquid. More specifically, a value (1.6 $GPa^{-1}$) of a hexane that falls into the category with the highest compressivity among types of liquid that are generally used as the mobile phase can be used. Alternatively, in a case where the liquid feeding device of the present embodiment is used as a liquid feeding pump of a supercritical chromatograph, a higher value of compressivity may be used as the predicted value by assuming liquefied carbon dioxide which is the mobile phase.

As described above, by using various embodiments of the present invention alone or in combination, the pre-compression speed V that satisfies all of a wide pressure range, a wide flow range, a difference in compressivity of a mobile phase, and requirements for cooperation between the closed pump and other plunger pumps required for a liquid feeding pump of a liquid chromatograph is provided. Furthermore, under more general and milder liquid feeding conditions (low to medium pressures, low to medium flow rates, in a case where compressivity of the mobile phase is small, and in a case where a plunger of a complementary pump is far from the deceleration start reference point provided slightly before the top dead center or the top dead center), the pre-compression process of the mobile phase is performed more isothermally. The isothermal pre-compression process suppresses the temperature increase of the mobile phase and makes it possible to reduce the flow rate compensation by the thermal compensation control. Even in a case where there is a deviation from an ideal state in the thermal compensation control, remaining of pulsation that cannot be compensated for is suppressed. Such pulsation improves the liquid feeding stability of the liquid feeding pump, and thus improves the reproducibility of chromatographic analysis.

DESCRIPTION OF REFERENCE SIGNS

1, 1*a*, 1*b*: Liquid feeding device
2: Primary pump (closed pump)
3, 23: Pump head
4, 24: Pump chamber
6, 28: Pump body
8, 30: Crosshead
10, 32: Plunger
12, 34: Motor
14, 36: Feed screw
16, 26: Check valve
20, 40: Pressure sensor
22: Secondary pump
42: Control part
44: Pre-compression part
46: Pre-compression speed determination part
48: Correlation holding part
50: Compressivity holding part
52: Possible discharge operation amount holding part

The invention claimed is:

1. A liquid feeding device comprising:

a discharge channel;

a pump part including a plurality of plunger pumps connected in series or in parallel to each other and discharging liquid to the discharge channel, at least one of the plurality of plunger pumps being a closed pump not connected to the discharge channel during a non-discharge time, the non-discharge time being a time in which the closed pump does not execute a discharge process for discharging liquid to the discharge channel;

a feeding pressure sensor detecting pressure in the discharge channel as a feeding pressure;

a non-discharge pressure sensor detecting pressure in a pump chamber of the closed pump during the non-discharge time as non-discharge pressure;

a pre-compression part configured to cause the closed pump to execute a pre-compression process after completing a suction process for sucking liquid into the pump chamber and during the non-discharge time based on output of the feeding pressure sensor and output of the non-discharge pressure sensor, the pre-compression process being a process to perform a discharge operation until the non-discharge pressure is substantially the same as the feeding pressure; and a pre-compression speed determination part configured to determine a speed of the discharge operation of the closed pump in the pre-compression process based on the feeding pressure and based on a specified correlation so that a maximum speed of the discharge operation of the closed pump in the pre-compression process becomes higher as the feeding pressure increases, wherein the pre-compression part is configured to cause the closed pump to perform the discharge operation at the speed determined by the pre-compression speed determination part in the pre-compression process.

2. The liquid feeding device according to claim 1, wherein the pre-compression part is configured to cause the closed pump to start the pre-compression process immediately after completion of the suction process of the closed pump, and the pre-compression speed determination part is configured to determine a speed of the discharge operation of the closed pump in the pre-compression process so that the pre-compression process of the closed pump is completed immediately before the discharge process of another plunger pump of the plurality of plunger pumps is finished.

3. The liquid feeding device according to claim 1, wherein the correlation is specified so that a speed of the discharge operation of the closed pump in the pre-compression process becomes higher as a difference between the feeding pressure and the non-discharge pressure is larger, the pre-compression speed determination part is configured to determine a new speed of discharge operation of the closed pump, while the closed pump is performing the pre-compression process, using the correlation, and the pre-compression part is configured to change a speed of the discharge operation of the closed pump to the new speed when the new speed of discharge operation of the closed pump is determined by the pre-compression speed determination part.

4. The liquid feeding device according to claim 1, wherein the correlation is specified so that a maximum speed of the discharge operation of the closed pump in the pre-compression process becomes higher as the target feeding flow rate increases.

5. The liquid feeding device according to claim 1, further comprising a compressivity storage part to store information regarding compressivity of liquid to be fed, wherein the correlation is specified so that a maximum speed of the discharge operation of the closed pump in the pre-compression process becomes higher as compressivity of liquid to be fed is higher.

6. The liquid feeding device according to claim 1, further comprising a possible discharge operation amount calculation part configured to calculate a possible discharge operation amount, the possible discharge operation amount being an amount that the other plunger pump in the plurality of plunger pumps, which is in the discharge process at the time when the pre-compression process of the closed pump is started, can perform the discharge operation before the other plunger pump in the plurality of plunger pumps reaches a top dead center or a deceleration start reference point set at a position where a plunger of the other plunger pump in the plurality of plunger pumps is slightly before the top dead center, wherein the correlation is specified so that a maximum speed of the discharge operation during the pre-compression process of the closed pump becomes lower as the possible discharge operation amount is larger.

7. A liquid feeding device comprising:

a discharge channel;

a pump part including a plurality of plunger pumps connected in series or in parallel to each other and discharging liquid to the discharge channel, at least one of the plurality of plunger pumps being a closed pump not connected to the discharge channel during a non-discharge time, the non-discharge time being a time in which the closed pump does not execute a discharge process for discharging liquid to the discharge channel;

a feeding pressure sensor detecting pressure in the discharge channel as a feeding pressure;

a non-discharge pressure sensor detecting pressure in a pump chamber of the closed pump during the non-discharge time as non-discharge pressure;

a pre-compression part configured to cause the closed pump to execute a pre-compression process after completing a suction process for sucking liquid into the pump chamber and during the non-discharge time based on output of the feeding pressure sensor and output of the non-discharge pressure sensor, the pre-compression process being a process to perform a discharge operation until the non-discharge pressure is substantially the same as the feeding pressure;

a compressivity storage part to store information regarding compressivity of the liquid to be fed; and a pre-compression speed determination part configured to determine a speed of the discharge operation of the closed pump in the pre-compression process based on compressivity of liquid to be fed and based on a specified correlation so that a maximum speed of the discharge operation of the closed pump in the pre-compression process becomes higher as the compressivity is higher, wherein the pre-compression part is configured to cause the closed pump to perform the discharge operation at the speed determined by the pre-compression speed determination part in the pre-compression process.

8. The liquid feeding device according to claim 7, wherein the pre-compression part is configured to cause the closed pump to start the pre-compression process immediately after completion of the suction process of the closed pump, and the pre-compression speed determination part is configured to determine a speed of the discharge operation of the closed pump in the pre-compression process so that the pre-compression process of the closed pump is completed immediately before the discharge process of the closed pump is started.

9. The liquid feeding device according to claim 7, wherein the correlation is specified so that a maximum speed of the discharge operation of the closed pump in the pre-compression process becomes higher as the target feeding flow rate increases.

10. The liquid feeding device according to claim 7, further comprising a possible discharge operation amount calculation part configured to calculate a possible discharge operation amount, the possible discharge operation amount being an amount that the other plunger pump in the plurality of plunger pumps, which is in the discharge process at the time when the pre-compression process of the closed pump is started, can perform the discharge operation before the other plunger pump in the plurality of plunger pumps reaches a top dead center or a deceleration start reference point set at a position where a plunger of the other plunger pump in the plurality of plunger pumps is slightly before the top dead center, wherein the correlation is specified so that a maximum speed of the discharge operation during the pre-compression process of the closed pump becomes lower as the possible discharge operation amount is larger.

11. A liquid feeding device comprising:

a discharge channel;

a pump part including a plurality of plunger pumps connected in series or in parallel to each other and discharging liquid to the discharge channel, at least one of the plurality of plunger pumps being a closed pump which is not connected to the discharge channel during a non-discharge time, the non-discharge time being a time in which the closed pump does not execute a discharge process for discharging liquid to the discharge channel;

a feeding pressure sensor detecting pressure in the discharge channel as a feeding pressure;

a non-discharge pressure sensor detecting pressure in a pump chamber of the closed pump during the non-discharge time as non-discharge pressure;

a pre-compression part configured to cause the closed pump to execute a pre-compression process after completing a suction process for sucking liquid into the pump chamber and during the non-discharge time based on output of the feeding pressure sensor and output of the non-discharge pressure sensor, the pre-compression process being a process to perform a discharge operation until the non-discharge pressure is substantially the same as the feeding pressure;

a possible discharge operation amount calculation part configured to calculate a possible discharge operation amount, the possible discharge operation amount being an amount that the other plunger pump in the plurality of plunger pumps, which is in the discharge process at the time when the pre-compression process of the closed pump is started, can perform the discharge operation before the other plunger pump in the plurality of plunger pumps reaches a top dead center or a deceleration start reference point set at a position where a plunger of the other plunger pump in the plurality of plunger pumps is slightly before the top dead center; and a pre-compression speed determination part configured to determine a speed of the discharge operation of the closed pump in the pre-compression process based on the possible discharge operation amount and based on a specified correlation so that a maximum speed of the discharge operation of the closed pump in the pre-compression process becomes lower as the possible discharge operation amount increases, wherein the pre-compression part is configured to cause the closed pump to perform the discharge operation at the speed determined by the pre-compression speed determination part in the pre-compression process.

12. The liquid feeding device according to claim 11, wherein the pre-compression part is configured to cause the closed pump to start the pre-compression process immediately after completion of the suction process of the closed pump, and the pre-compression speed determination part is configured to determine a speed of the discharge operation of the closed pump in the pre-compression process so that the pre-compression process of the closed pump is completed immediately before the discharge process of the closed pump is started.

13. The liquid feeding device according to claim 11, wherein the correlation is specified so that a maximum speed of discharge operation of the closed pump in the pre-compression process becomes higher as the target feeding flow rate increases.

* * * * *